US006561641B1

(12) United States Patent
DeFosse et al.

(10) Patent No.: US 6,561,641 B1
(45) Date of Patent: May 13, 2003

(54) PRECISION WRITING LINE CONTROL PLATEN FOR HIGH RESOLUTION INK JET PRINTING

(75) Inventors: Stephen Francis DeFosse, Lexington, KY (US); David Kyle Murray, Lexington, KY (US); Mark Alan Wahl, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/502,803

(22) Filed: Feb. 11, 2000

(51) Int. Cl.[7] ..... B41J 2/01; B41J 11/20
(52) U.S. Cl. ..... 347/104; 400/55; 400/58
(58) Field of Search ..... 347/104, 108; 400/23, 656, 691, 693, 694, 55, 58

(56) References Cited

U.S. PATENT DOCUMENTS

| | | | | |
|---|---|---|---|---|
| 4,186,162 | A | 1/1980 | Daley | |
| 4,583,272 | A | 4/1986 | Keller | 29/110 |
| 4,676,683 | A | 6/1987 | Uchikata et al. | 400/656 |
| 4,715,734 | A | 12/1987 | Pamler | 400/56 |
| 4,749,296 | A | 6/1988 | Bohmer | 400/659 |
| 4,929,106 | A | 5/1990 | Buan et al. | 400/649 |
| 4,932,797 | A | 6/1990 | Emenaker et al. | 400/56 |
| 4,936,697 | A | 6/1990 | Weller et al. | 400/660.2 |
| 4,957,382 | A | 9/1990 | Delaney et al. | 400/656 |
| 4,984,917 | A | 1/1991 | Hauslaib et al. | 400/656 |
| 5,090,825 | A | 2/1992 | Merriman, Jr. et al. | 400/58 |
| 5,173,596 | A * | 12/1992 | Kapinos et al. | 235/475 |
| 5,356,229 | A | 10/1994 | Hickman et al. | 400/642 |
| 5,515,094 | A | 5/1996 | Tanaka et al. | 347/104 |
| 5,684,516 | A | 11/1997 | Cseledy et al. | 347/8 |
| 5,797,687 | A | 8/1998 | Petersen et al. | 400/23 |
| 5,805,176 | A | 9/1998 | Saito et al. | 347/8 |
| 5,807,004 | A | 9/1998 | Takei et al. | 400/661.1 |
| 5,816,724 | A | 10/1998 | Hada et al. | 400/656 |
| 5,821,952 | A | 10/1998 | Martenson et al. | 347/8 |
| 5,874,979 | A | 2/1999 | Ohyama | 347/104 |
| 5,902,059 | A | 5/1999 | Asai et al. | 400/605 |
| 6,036,380 | A | 3/2000 | Astroth et al. | 400/23 |
| 6,193,347 | B1 * | 2/2001 | Askeland et al. | 347/15 |

OTHER PUBLICATIONS

Cahners Publishing Associates LP, 1996; otained through ZDNet Services (Internet).*

* cited by examiner

*Primary Examiner*—John Barlow
*Assistant Examiner*—Alfred E Dudding
(74) *Attorney, Agent, or Firm*—Taylor & Aust, PC

(57) ABSTRACT

An ink jet printer jets ink onto a section of a front side of a print medium. The ink jet printer includes an ink jetting printhead facing the front side of the print medium. A media support apparatus opposes the printhead. The media support apparatus includes a substantially flexible body having an outer surface engaging a back side of the print medium such that the section of the print medium receiving the ink is substantially flat. A substantially rigid elongate element engages the body and has a length direction substantially perpendicular to a feed direction of the print medium. The elongate element provides at least a portion of the outer surface of the body with a predetermined degree of straightness.

21 Claims, 3 Drawing Sheets

PRECISION WRITING LINE CONTROL PLATEN FOR HIGH RESOLUTION INK JET PRINTING

BACKGROUND OF THE INVENTION

1. Field of the Invention

The present invention relates to ink jet printers, and, more particularly, to a platen for an ink jet printer.

2. Description of the Related Art

An ink jet printer generally includes a platen for supporting a sheet of print medium, such as paper, while an ink jetting printhead deposits ink on the print medium. Beyond merely supporting the print medium, the platen serves to establish and maintain a fixed gap between the printhead and the print medium in order to maximize the printing quality. That is, the platen ensures that the height of the gap between the printhead and the print medium is constant across the width of the platen. The platen includes an outer flat surface, opposing the printhead, upon which the print medium may rest or be biased against.

It is known to form a platen of a single continuous piece of molded plastic. With ink jet printers that print with a resolution of 300 dots per inch (dpi) or 600 dots per inch, the flatness tolerances on the outer surface of the platen which can be achieved through plastic molding are tight enough to produce an acceptable print quality. With high resolution ink jet printers (1200 dpi and greater), however, the flatness tolerance of the outer surface of the platen is a limiting factor of the print quality. That is, the print quality that is achieved with a high resolution ink jet printer can be limited by the flatness of the plastic molded platen. The main cause of the lack of flatness is that the flexibility of the plastic allows it to bend or warp in one direction or another along the width of the platen. Although it is possible to machine a platen to the flatness required by high resolution ink jet printing, the costs associated with such machining are very high.

What is needed in the art is a platen which can be inexpensively manufactured with a flatness tolerance that is tighter than what can be achieved with conventional plastic molding alone.

SUMMARY OF THE INVENTION

The present invention provides a plastic platen which is biased by a precision ground metal shaft attached thereto such that the outer surface of the platen has a flatness tolerance which is tighter than what can be achieved with conventional plastic molding alone.

The invention comprises, in one form thereof, an ink jet printer for jetting ink onto a section of a front side of a print medium. The ink jet printer includes an ink jetting printhead facing the front side of the print medium. A media support apparatus opposes the printhead. The media support apparatus includes a substantially flexible body having an outer surface engaging a back side of the print medium such that the section of the print medium receiving the ink is substantially flat. A substantially rigid elongate element engages the body and has a length direction substantially perpendicular to a feed direction of the print medium. The elongate element provides at least a portion of the outer surface of the body with a predetermined degree of straightness.

An advantage of the present invention is that the platen can hold the paper it supports within a flatness tolerance that is tighter than can be achieved by conventional platens.

Another advantage is that it is much less expensive to grind the metal shaft of the present invention to the required straightness than to machine an entire platen to the required straightness.

Yet another advantage is that the platen can be manufactured with minimal assembly time.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
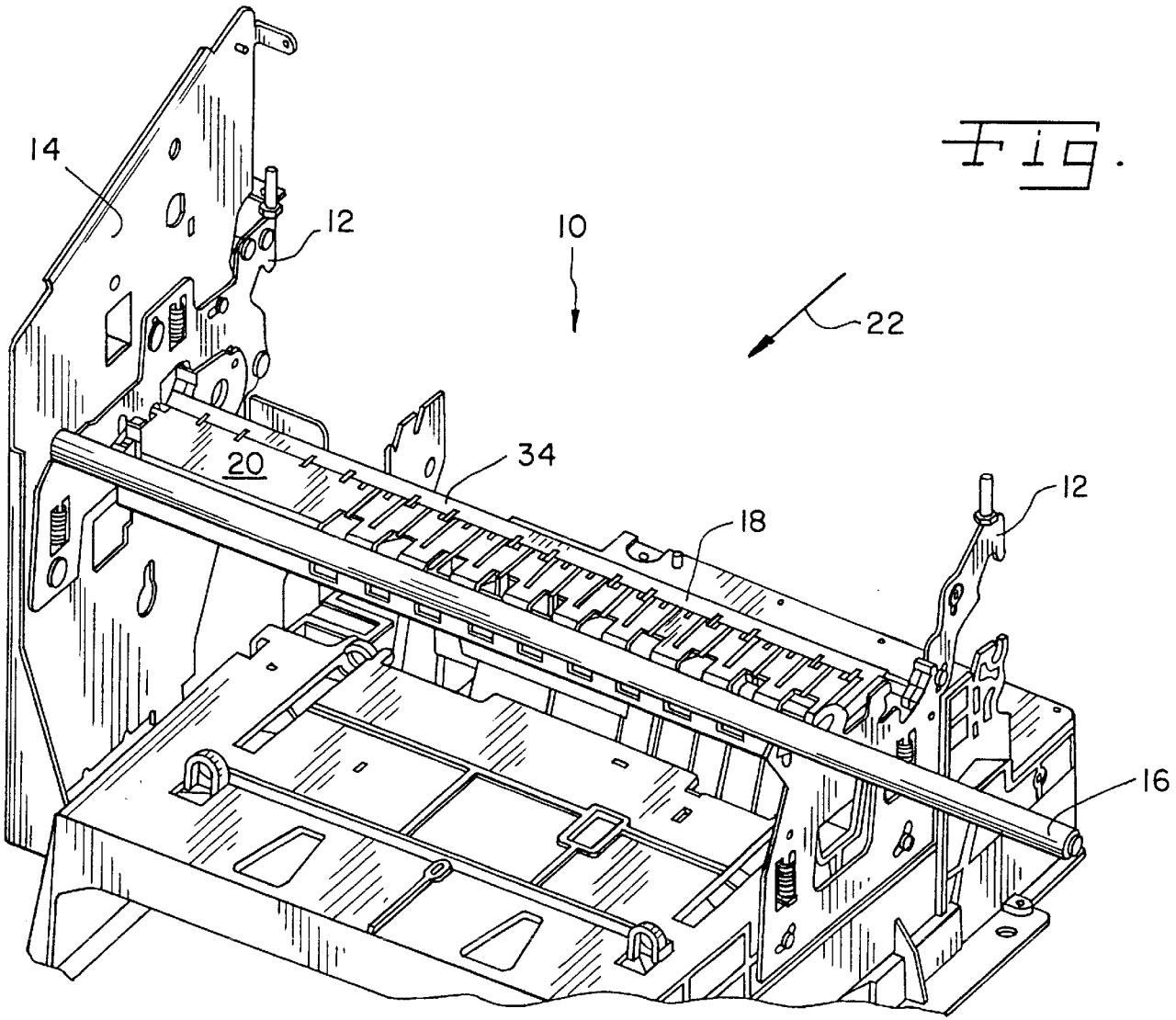
FIG. 1 is a partial, perspective view of an ink jet printer including one embodiment of the platen of the present invention.
Figure 2:
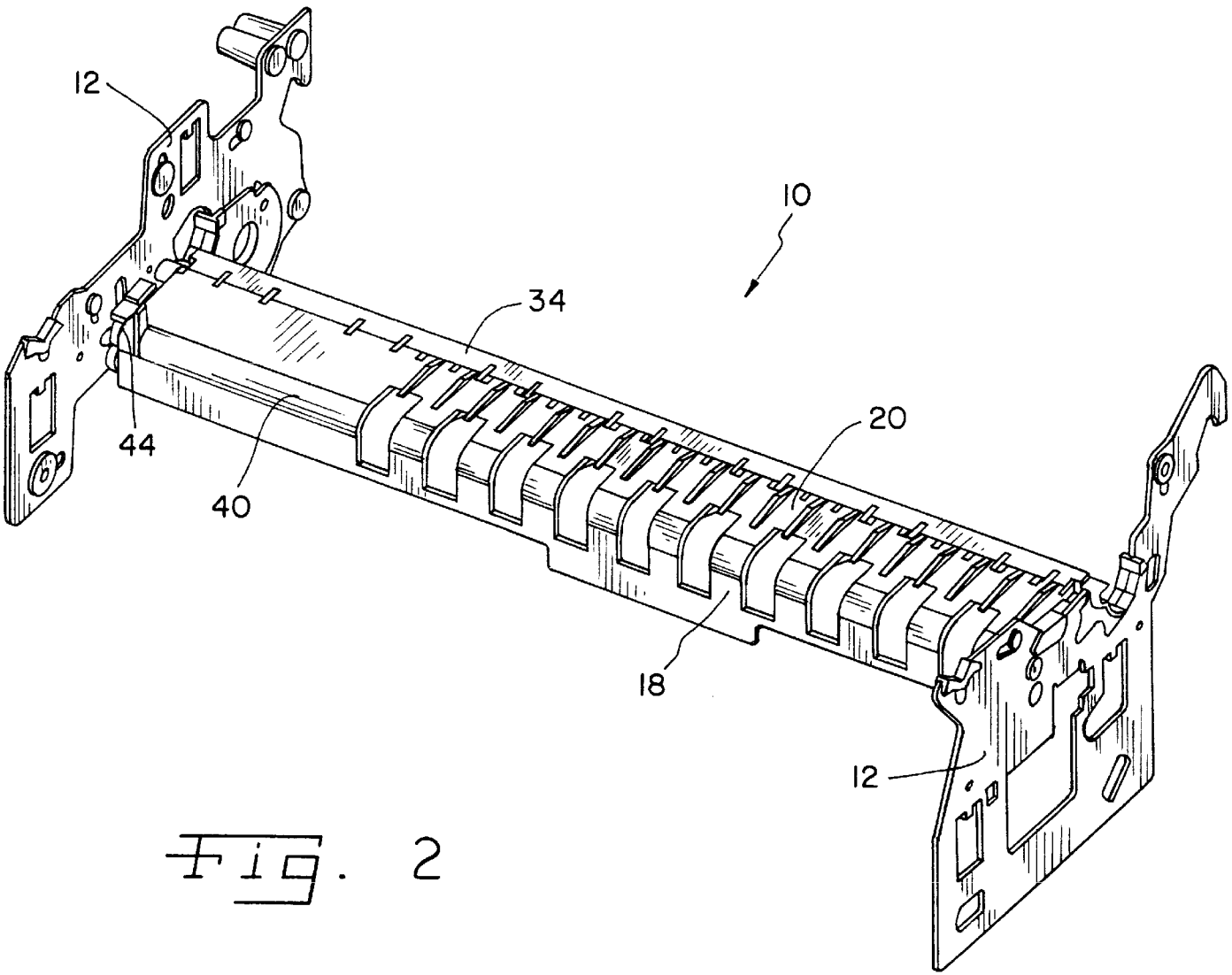
FIG. 2 is a perspective view of the side plates and the platen of FIG. 1.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings, and particularly to FIG. 1, there is shown a portion of an ink jet printer including a print media support apparatus in the form of a platen assembly 10 connected to side plates 12, frame 14 and a fixed 12 mm shaft 16.

Figure 3:
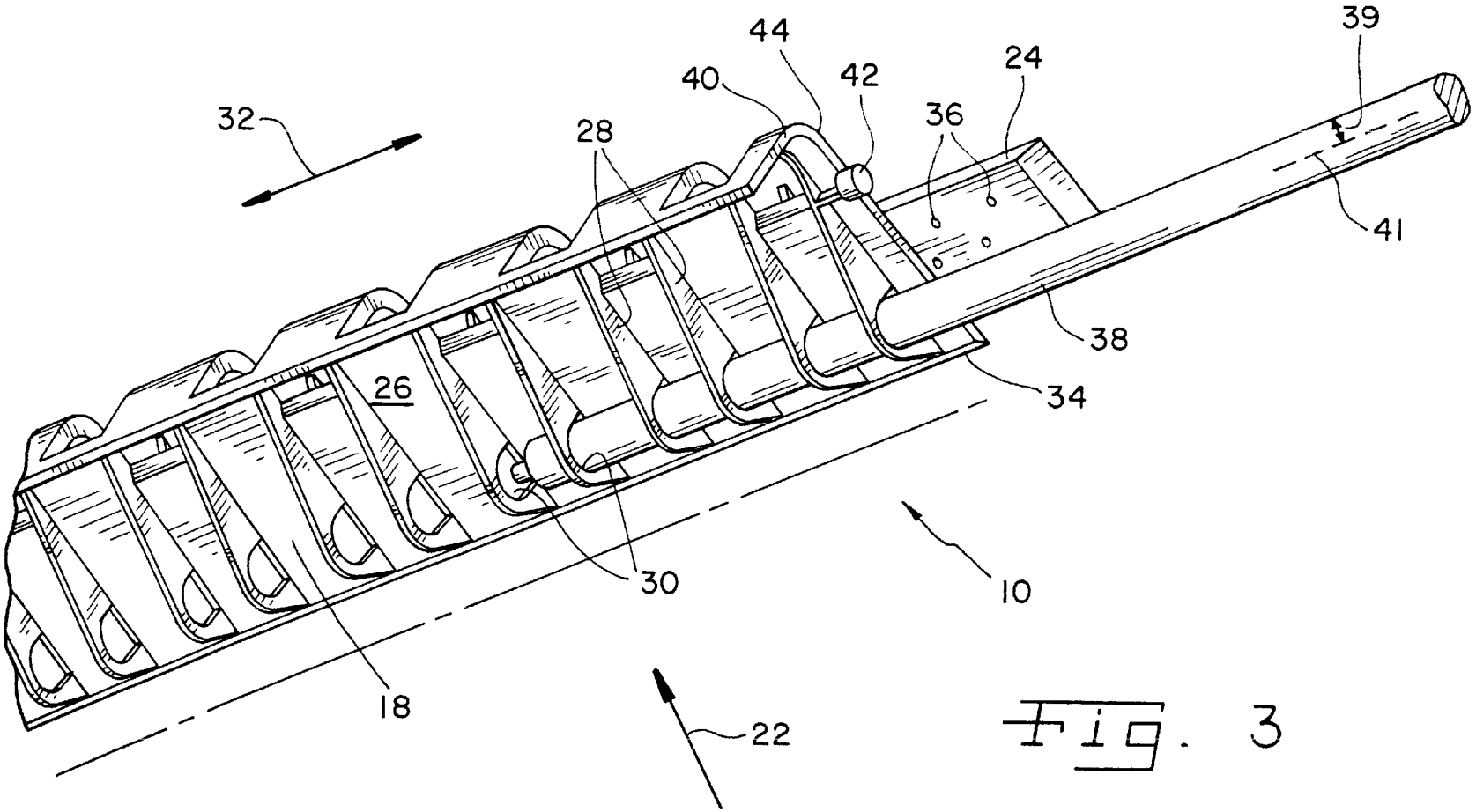
FIG. 3 is a bottom, perspective view of the platen of FIGS. 1 and 2, along with an associated printhead.

Platen assembly 10 includes a plastic molded body 18 having an outer surface 20 which engages and supports a back side of a print medium, such as a sheet of paper, which is fed through the printer in the direction indicated by arrow 22. Outer surface 20 is positioned generally opposite a printhead 24 (FIG. 3) in the printer such that printhead 24 can jet ink onto a section of the front surface of the print medium. Printhead 24 is capable of printing with a high resolution, i.e., 1200 dpi or greater.

A bottom surface 26 of body 18, disposed opposite outer surface 20, has ribs 28 extending perpendicularly therefrom. Each rib 28 is separated from adjacent ribs 28 by approximately 15 mm. Body 18 also has openings 30 aligned along a width direction 32 of body 18. Each opening 30 is in a respective one of ribs 28. Openings 30 are disposed immediately below and adjacent to a leading edge 34 of outer surface 20. Leading edge 34 is a rectangular edge portion of outer surface 20 of body 18 which functions as the paper contact surface. Leading edge 34 supports a back surface of a section of the print medium that receives ink from printhead 24. That is, leading edge 34 opposes printhead 24 and lies directly below nozzles 36 of printhead 24.

Platen assembly 10 also includes a metal, cylindrical shaft 38 which is inserted through openings 30. Shaft 38 is tightly received within openings 30 such that the edges of each opening 30 exert substantial clamping forces upon shaft 38, thereby fixedly attaching shaft 38 to body 18. Shaft 38 has a length of approximately 215 mm, approximately equal to the width of body 18 in direction 32. Shaft 38 is manufactured with a straightness of less than 0.025 mm along its length. That is, assuming shaft 38 is oriented horizontally, the vertical position of the uppermost point on the peripheral surface of shaft 38 varies by no more than 0.025 mm along the length of shaft 38. In other words, a radius 39 of shaft 38, as measured relative to an imaginary, perfectly linear longitudinal axis 41 of shaft 38, varies by no more than 0.025 mm along the length of shaft 38 and along its circumference. More preferably, shaft 38 has a straightness of less than 0.02 mm.

When shaft 38 has been inserted into openings 30, shaft 38 forces outer surface 20, and, more particularly, leading edge 34 to conform to the straightness of shaft 38. Although body 18 may be slightly warped in its unbiased state, the rigidity of shaft 38 biases the flexible body 18 such that outer surface 20 is forced to conform to the flatness of shaft 38. In one embodiment, after insertion of shaft 38, leading edge 34 is flat within a 0.05 mm range over the 215 mm width of body 18. That is, assuming printhead 24 is perfectly aligned and flat, the gap between outer surface 20 and printhead 24 varies by no more than 0.05 mm across the 215 mm width of body 18. In other words, a difference between respective vertical positions of an absolute highest point on leading edge 34 and an absolute lowest point on leading edge 34 is less than 0.05 mm.

Outer surface 20 also includes a trailing edge 40 having a boss or projection 42 extending in direction 32 at each of two opposite ends 44 of trailing edge 40. Bosses 42 are received in respective recesses (not shown) in side plates 12. Thus, by rigidly attaching the opposite ends of shaft 38 to respective side plates 12, the relative positions of bosses 42 and shaft 38 can be fixed. By constraining body 18 along leading edge 34 and at opposite ends 44 of trailing edge 40, the entire outer surface 20 of body 18 can be held substantially flat.

Openings 30 of body 18 are shown to be arcuate or circular. In another embodiment (not shown), openings 30 can be V-shaped in cross-section in order to exert a more localized clamping force on shaft 38. That is, the clamping force is exerted at two contact points on respective opposite sides of the V-shaped cross-section.

Openings 30 are shown as being disposed in a series of ribs 28 extending from a bottom surface 26 of body 18. However, it is to be understood that body 18 can also have one continuous opening or channel extending across its width, perpendicular to feed direction 22.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inkjet printer for jetting ink onto at least a section of a front side of a print medium, the print medium having a feed direction, said ink jet printer comprising:

an ink jetting printhead configured for facing the front side of the print medium; and a media support apparatus opposing said printhead, said media support apparatus including:

a substantially flexible body having an outer surface configured for engaging a back side of the print medium such that the section of the print medium receiving the ink is substantially flat; and a substantially rigid shaft fixedly engaging said body, said shaft having a length direction substantially perpendicular to the feed direction of the print medium, said shaft being configured for providing at least a portion of said outer surface of said body with a predetermined degree of straightness.

2. The printer of claim 1, wherein said printhead is configured for printing with a resolution of at least 1200 dots per inch.

3. The printer of claim 1, wherein said portion of said outer surface of said body comprises a leading edge of said outer surface, a difference in vertical positions between an absolute highest point on said leading edge and an absolute lowest point on said leading edge being less than 0.05 mm.

4. The apparatus of claim 1, wherein said body has a width direction substantially parallel to the length direction of said shaft, said body including a plurality of openings substantially aligned along said width direction, said shaft being tightly received within said openings.

5. The apparatus of claim 4, wherein said openings of said body exert at least one clamping force on said shaft.

6. The apparatus of claim 1, further comprising at least one structural element having a fixed position relative to said shaft, said outer surface of said body includes a trailing edge having two opposite ends, at least one of said opposite ends of said trailing edge having one of a projection and a recess mating with a respective said structural element.

7. The apparatus of claim 1, wherein said shaft is substantially cylindrical.

8. An ink jet printer for jetting ink onto at least a section of a front side of a print medium, the print medium having a feed direction, said ink jet printer comprising:

an ink jetting printhead configured for facing the front side of the print medium and printing with a resolution of at least 1200 dots per inch; and a media support apparatus opposing said printhead, said media support apparatus including:

a substantially flexible body having an outer surface configured for engaging a back side of the print medium such that the section of the print medium receiving the ink is substantially flat; and a metal, cylindrical shaft fixedly engaging said body, said shaft having a length direction substantially perpendicular to the feed direction of the print medium, said shaft being configured for providing at least a portion of said outer surface of said body with a predetermined degree of straightness.

9. The printer of claim 8, herein said shaft has a radius and a length, said radius varying along said length by less than 0.025 mm.

10. An inkjet printer for jetting ink onto at least a section of a front side of a print medium, the print medium having a feed direction, said ink jet printer comprising:

an ink jetting printhead configured for facing the front side of the print medium; and a media support apparatus opposing said printhead, said media support apparatus including:

a substantially flexible body having an outer surface configured for engaging a back side for the print medium such that the section of the print medium receiving the ink is substantially flat; and a substantially rigid elongate element fixedly engaging said body, said elongate element having a length direction substantially perpendicular to the feed direction of the print medium, said elongate element being configured for providing at least a leading edge of said outer surface of said body with a predetermined degree of straightness such that a difference in vertical positions between an absolute highest point on said leading edge and an absolute lowest point on said leading edge is less than 0.05 mm, said elongate element being adjacent to said leading edge.

11. An inkjet printer for jetting ink onto at least a section of a front side of a pit medium, the print medium having a feed direction, said ink jet printer comprising:

an ink jetting printhead configured for facing the front side of tic print medium; and a media support apparatus opposing said printhead, said media support apparatus including:

a substantially flexible body having:

a width direction;

an outer surface configured for engaging a back side of the print medium such that the section of the print medium receiving the ink is substantially flat;

a second surface opposite said outer surface; and a plurality of ribs extending transversely from said second surface, each said rib having a corresponding opening, said openings being substantially aligned along said width direction; and a substantially rigid elongate element fixedly received within said openings, said elongate element having a length direction substantially perpendicular to the feed direction of the print medium and substantially parallel to the width direction of said body, said elongate element being configured for providing at least a portion of said outer surface of said body with a predetermined degree of straightness.

12. A media support apparatus for supporting a print medium opposite an ink jetting printhead in an ink jet printer, the print medium having a feed direction, said media support apparatus comprising:

a substantially flexible body having an outer surface configured for engaging a back side of the print medium opposite the printhead, said outer surface having a leading edge; and a substantially rigid elongate element adjacent to said leading edge and fixedly engaging said body, said elongate element having a length direction transverse to the feed direction of the print medium, said elongate element being configured for providing said leading edge of said outer surface of said body with a predetermined degree of straightness.

13. A method of printing on a print medium using an ink jet printer, said method comprising the steps of:

providing a substantially flexible platen having an outer surface;

biasing said platen with a shaft such that at least a portion of said outer surface has at least a predetermined degree of flatness;

fixedly attaching said shaft to said platen;

positioning said outer surface of said platen in opposition to an ink jetting printhead while maintaining said platen in said biased state;

feeding the print medium into a gap between said printhead and said outer surface of said platen;

supporting a back side of the print medium with said portion of said outer surface of said platen such that a section of the print medium opposing said printhead is substantially flat; and jetting ink onto the section of the print medium with said printhead.

14. The method of claim 13, wherein said providing step includes molding said platen of a plastic material, said biasing step occurring after completion of said molding step.

15. The method of claim 13, wherein said biasing and fixing steps include inserting said shaft into a plurality of openings in said platen.

16. The method of claim 13, wherein said biasing step includes forcing said platen to conform to a straightness of said shaft.

17. The method of claim 13, wherein said jetting step includes printing with a resolution of at least 1200 dots per inch.

18. The method of claim 13, wherein said predetermined degree of flatness comprises being flat within a 0.05 mm range over a width of at least 200 mm.

19. The method of claim 13, wherein said outer surface of said platen includes a trailing edge having two opposite ends, at least one of said opposite ends of said trailing edge having one of a projection and a recess, said method comprising the further steps of:

providing a structural element having a fixed position relative to said shaft; and mating said one of a projection and a recess with said structural element.

20. The method of claim 13, wherein said shaft is substantially rigid.

21. The method of claim 13, wherein said shaft is substantially cylindrical.

* * * * *